US009410297B2

(12) United States Patent
Ustrell I Mussons

(10) Patent No.: US 9,410,297 B2
(45) Date of Patent: Aug. 9, 2016

(54) MECHANISM FOR REDUCING THE SPEED OF ROAD TRAFFIC AND CORRESPONDING SPEED BUMP

(71) Applicant: Raül Ustrell I Mussons, Barcelona (ES)

(72) Inventor: Raül Ustrell I Mussons, Barcelona (ES)

( * ) Notice: Subject to any disclaimer, the term of this patent is extended or adjusted under 35 U.S.C. 154(b) by 0 days.

(21) Appl. No.: 14/409,544

(22) PCT Filed: Jun. 18, 2013

(86) PCT No.: PCT/ES2013/070394

§ 371 (c)(1),
(2) Date: Dec. 19, 2014

(87) PCT Pub. No.: WO2013/190159

PCT Pub. Date: Dec. 27, 2013

(65) Prior Publication Data

US 2015/0176232 A1 Jun. 25, 2015

(30) Foreign Application Priority Data

Jun. 19, 2012 (ES) ..... 201230958

(51) Int. Cl.
*E01F 9/047* (2006.01)
*E01C 9/00* (2006.01)

(52) U.S. Cl.
CPC .. *E01F 9/047* (2013.01); *E01C 9/00* (2013.01)

(58) Field of Classification Search
CPC ..... E01F 9/047; E01F 13/123; E01F 13/00; E01F 13/12; E01F 13/10; G08G 1/07; E01C 9/00
See application file for complete search history.

(56) References Cited

U.S. PATENT DOCUMENTS 2,917,283 A * 12/1959 Sumners ..... G07F 17/145 194/902
3,295,255 A * 1/1967 Russo ..... E01F 13/105 188/32
3,325,782 A * 6/1967 Der ..... E01F 13/105 340/935
4,490,068 A * 12/1984 Dickinson ..... E01F 13/08 404/11
4,974,991 A * 12/1990 Mandavi ..... E01F 13/105 404/11
5,486,065 A * 1/1996 James ..... E01F 9/047 404/15

(Continued)

FOREIGN PATENT DOCUMENTS

ES 1 048 038 U 6/2001
ES 2 296 517 A1 4/2008

(Continued)

*Primary Examiner* — Abigail A Risic
(74) *Attorney, Agent, or Firm* — McGlew and Tuttle, P.C.

(57) ABSTRACT

A mechanism for reducing the speed of road traffic and corresponding speed bump. A mechanism for reducing the speed of road traffic on public thoroughfares comprising [a] a collapsible surface (1) which moves between a raised position and a lowered position, where the collapsible surface is normally in the raised position, and [b] retaining means (19) adapted to retaining the collapsible surface in the raised position. The retaining means are activated when the speed of movement of the collapsible surface is greater than a predetermined maximum speed. With this mechanism it is possible to make a speed bump for reducing the speed of road traffic comprising one or two of these mechanisms. If it comprises two mechanisms, each of them has a width of less than 1.2 m and they are spaced apart at a distance such that an automobile rides simultaneously over both mechanisms.

17 Claims, 2 Drawing Sheets

(56) References Cited

U.S. PATENT DOCUMENTS

| | | | | |
|---|---|---|---|---|
| 5,509,753 | A * | 4/1996 | Thompson | E01F 9/047 404/11 |
| 6,457,900 | B2 * | 10/2002 | Bond | E01F 9/047 404/15 |
| 6,726,399 | B2 * | 4/2004 | Heeks | F16K 17/048 404/15 |
| 6,877,929 | B1 * | 4/2005 | Yang | E01F 13/126 404/10 |
| 7,004,193 | B2 * | 2/2006 | Heeks | E01F 9/047 137/512.2 |
| 7,476,052 | B2 * | 1/2009 | Hall | E01F 9/047 404/15 |
| 2003/0143023 | A1 | 7/2003 | Heeks et al. | |
| 2004/0177888 | A1 * | 9/2004 | Heeks | E01F 9/047 137/599.18 |
| 2005/0063779 | A1 | 3/2005 | Yang | |

FOREIGN PATENT DOCUMENTS

| | | | |
|---|---|---|---|
| ES | 2 306 606 | A1 | 11/2008 |
| ES | 1 069 401 | U | 3/2009 |
| ES | 2342765 | A1 | 7/2010 |
| MX | 258699 | | 7/2008 |
| WO | 2005103386 | A1 | 11/2005 |

* cited by examiner

MECHANISM FOR REDUCING THE SPEED OF ROAD TRAFFIC AND CORRESPONDING SPEED BUMP

FIELD OF THE INVENTION

The invention relates to a mechanism for reducing the speed of road traffic on public thoroughfares comprising: [a] a collapsible surface adapted for reversibly moving between a first raised position and a second lowered position, where the collapsible surface is normally in the first raised position, such that it is visible to the road traffic, and [b] retaining means adapted for retaining the collapsible surface in the raised position.

The invention also relates to a speed bump for reducing the speed of road traffic on public thoroughfares comprising a mechanism according to the invention.

STATE OF THE ART

There are currently different designs of speed bumps placed on the public thoroughfares for regulating the speed of road traffic. These speed bumps modify the road surface, urging drivers to reduce speed because of the shocks transmitted to the vehicles when they pass over them. On the other hand, they have the drawback of still causing considerable shocks in the vehicles even though they respect the speed on the thoroughfare on which they are installed, with the consequent deterioration of various vehicle components, mainly the suspension.

In ES P201030189 there are disclosed speed bumps including a mechanism for reducing the speed of road traffic, the behavior of which varies depending of the speed of the approaching vehicle. These mechanisms can be designed in such a way that they are fully mechanical, so that they do not need any source of electric power and furthermore, the collapsible surface is visible when the vehicle approaches, whereby the driver can see the collapsible surface and adjust the speed in consequence.

Further speed bumps which vary their behavior depending on the speed of the approaching vehicle may be found described in ES 1,048,038, ES 2,296,517, ES 2,306,606, MX258699 and ES 1,069,401.

The installation of this type of speed bumps is becoming increasingly more usual, whereby there is a need to improve them, reduce the cost thereof, simplify the mechanical complexity thereof, as well as to increase the reliability thereof.

SUMMARY OF THE INVENTION

It is an object of the invention to overcome these drawbacks. This purpose is achieved by a mechanism of the type indicated at the beginning, characterized in that the retaining means are adapted for being activated when the speed of movement of the collapsible surface is higher than a predetermined maximum speed.

In fact, in the prior art mechanisms, a vehicle presence sensor was required, from which the speed of the vehicle was directly or indirectly determined and this activated (or not) the corresponding blocking means. Nevertheless, in the mechanism of the invention the parameter that will activate the retaining means is directly the speed of movement of the collapsible surface. Namely, the vehicle will approach until it touches the collapsible surface with the front wheel and, on continuing to move forward, will force the collapsible surface to move at a speed which will be greater or smaller depending on the vehicle's speed. The mechanism of the invention takes this speed of movement of the collapsible surface into account to activate the retaining means.

Since the vehicle is already on the collapsible surface, the whole system is required to have a rapid response. In this sense, the retaining means advantageously comprise a device of the group formed by a pneumatic or hydraulic circuit comprising a parachute valve (also named hose break valve, from Spanish "válvula paracaídas"), a centrifugal brake and centrifugal blocking means (also known as mechanical parachute system).

The mechanism preferably has means for kinematic transmission of the movement of the collapsible surface to a rotational member comprising activation means adapted for activating said retaining means, from a particular angular velocity. In this case the retaining means preferably comprise a centrifugal brake and/or centrifugal blocking means (mechanical parachute system)

In fact, this ensemble of solutions comprises strictly mechanical means, wherein advantage is taken of the centrifugal force generated when the rotational member is caused to rotate. In all cases, it is possible to calibrate the mechanism such that the retaining means are not activated if the centrifugal force is less than a pre-established value (where the centrifugal force is consequence of the speed of rotation which in turn is consequence of the speed of movement of the collapsible surface which, as has already been said above, depends on the speed of the vehicle in the instant it moves onto the collapsible surface). In the case of the centrifugal brake, the effect will be a "hardening" of the force required to collapse the collapsible surface, such that this hardening may be variable depending on the speed of the vehicle. In turn, a complete blocking of the collapsible surface, which will not collapse until the applied force has disappeared, will be obtained with the mechanical parachute system.

A further advantageous alternative is had when the mechanism is provided with means for kinematic transmission of the movement of the collapsible surface to a fluid in a hydraulic or pneumatic circuit where said hydraulic or pneumatic circuit comprises activation means adapted for activating said retaining means from a predetermined speed, pressure or flow rate of said fluid where said retaining means cause the interruption of the flow of the fluid, which causes blocking of said transmission means. In fact, in this case the philosophy of the system is based on hydraulic or pneumatic circuits (which may also be completely independent of an electric supply). In these cases, the retaining means preferably comprise a parachute valve (hose break valve).

Generally speaking, the said retaining means are known in safety applications as, for example, safety systems in elevators, mountaineering, etc. For example, the companies HYDAC INTERNATIONAL and ELEVALIA market hydraulic parachute valves for sundry applications. The company GRUPO EIDE markets mechanical parachute systems and centrifugal blocking brakes.

The collapsible surface moves preferably between a first position and a second position by way of a rotational movement and the mechanism comprises, additionally, a first kinematic mechanism for converting the rotational movement into a translational movement. In fact, the collapsible surface may be moved in different ways, some of which have already been described in the aforementioned document ES P201030189 (see, for example, FIG. 3 and FIG. 5 and the corresponding parts of the description). In the case of a rotational movement, it may be advantageous to convert this rotational movement into a translational movement to activate retaining means which require to be activated by a translational movement. Thus, for example, an advantageous solution in this case is when the first kinematic mechanism is connected to the rod of the piston of a hydraulic or pneumatic cylinder having a first outlet and a second outlet for a fluid, where between the first outlet and the second outlet there is an external circuit comprising a parachute valve (hose break valve). In this case, the translational movement will move the rod and the piston fixedly attached thereto, which will cause the fluid contained in the cylinder chambers to flow from one chamber to the other at a speed (flow-rate) which will depend on the vehicle speed. If this speed (or flow-rate) exceeds a pre-established threshold value, the parachute valve will close the fluid passage, which will cause the piston and, consequently, the collapsible surface to be retained.

The rod is preferably attached to return spring means, which allows the collapsible surface to return to the first raised position thereof, after the vehicle has passed thereover.

Where the collapsible surface moves between the first position and the second position by means of a rotational movement and the mechanism additionally comprises a first kinematic mechanism for conversation of the rotational movement into a translational movement, a further advantageous alternative is obtained when the mechanism comprises, additionally, a second kinematic mechanism for conversion of the translational movement into a second rotational movement and comprises a centrifugal brake and/or centrifugal blocking means coupled to the second kinematic mechanism. In fact, the centrifugal brake (and/or the centrifugal blocking means) can be connected directly to the collapsible surface (to its rotational shaft) or may be connected by, for example, a "rotational" kinematic mechanism (for example, a gear train). Nevertheless, in certain cases, it may be of interest for the retaining means (the centrifugal brake or the centrifugal blocking means) to be physically farther removed from the rotational shaft of the collapsible surface (for example, because of a problem of space). In this case, it may be of interest to have this pair of movement conversion mechanisms available.

The invention also has as an object a speed bump for reducing the speed of road traffic in public thoroughfares characterized in that it is provided with a mechanism according to the invention. Preferably the speed bump comprises two mechanisms according to the invention, where each of the mechanisms has a width of less than 1.2 m (preferably a width of 1 m), where the mechanisms are spaced apart at such a distance that a car rides simultaneously over both mechanisms, both mechanisms being connected together by a fixed bump table.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1:
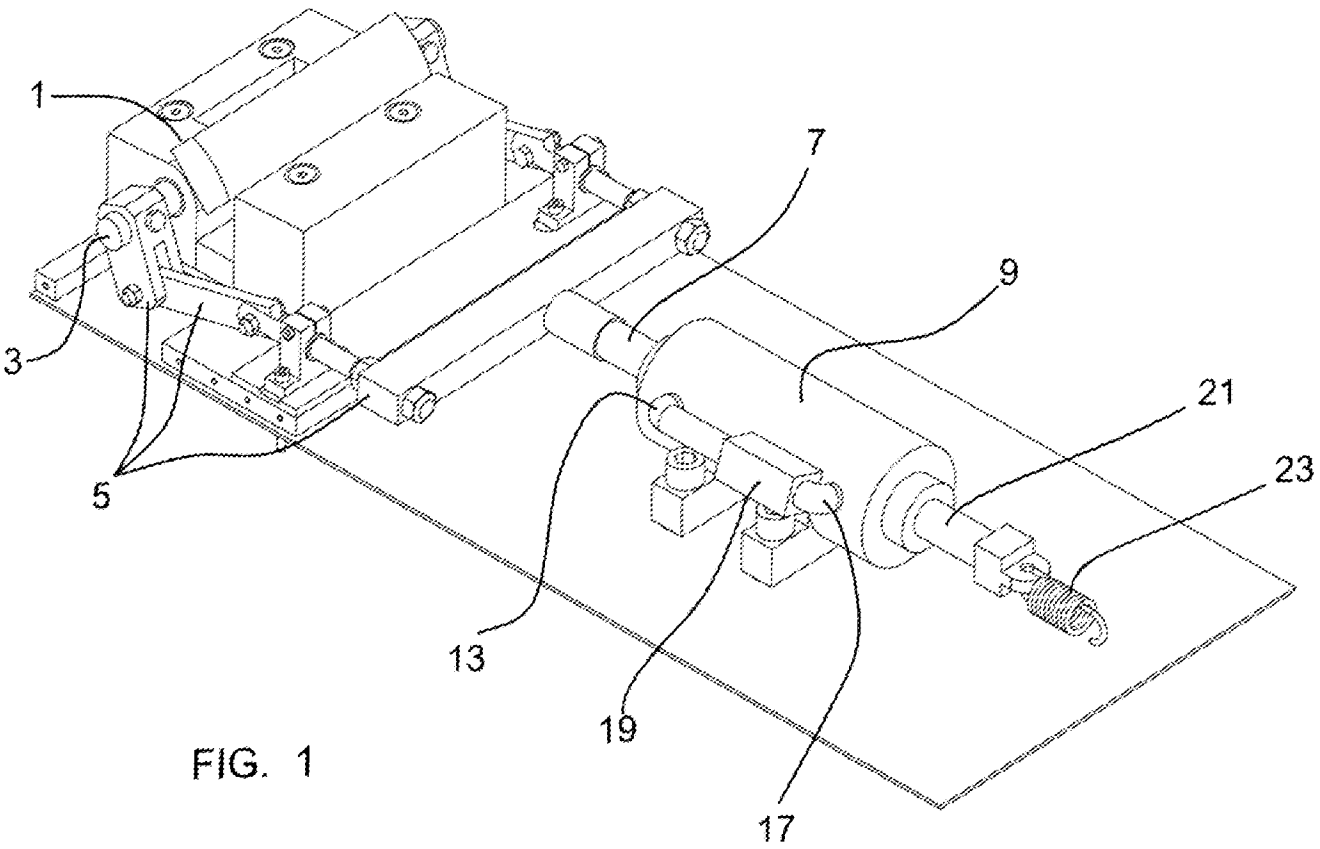
FIG. 1 is a perspective view of a speed bump with a first mechanism according to the invention.

FIG. 1 shows a speed bump with a mechanism for reducing the speed of road traffic in public thoroughfares. The mechanism comprises a collapsible surface 1 adapted to rotate around a shaft of rotation 3 between a first raised position (as shown in FIG. 1) and a second lowered position, in which it is aligned with the road on which the vehicles are circulating. The mechanism also comprises a first kinematic conversion mechanism 5 which converts the rotational movement of the shaft of rotation 3 into a translational movement. This first kinematic mechanism 5 is connected to the end of a rod 7 of a piston of a cylinder 9 which has a first chamber with a first outlet 13 and a second chamber with a second outlet 17, where both outlets 13 and 17 are connected together over an external circuit comprising retaining means 19 which, in this particular case, is a parachute valve (hose break valve). The parachute valve allows the fluid to flow freely in one direction and in the other direction only if the speed of the fluid (or the flow-rate thereof) is less than a predetermined value. If it exceeds this value, an internal sealing member is subjected to an aerodynamic or hydrodynamic force which pushes it against the corresponding valve seat, which force is greater than the force of spring means retaining it in a spaced apart position from the valve seat. Therefore, for a flow-rate greater than the admissible maximum one, the parachute valve closes and blocks the passage of the fluid.

The piston 9 has a second rod 21, opposite to the rod 7, which is attached by a spring to a fixed member of the mechanism or of the speed bump. This spring acts as the return spring means 23, since once the vehicle has passed, the spring brings the collapsible surface 1 to the first raised position thereof.

Figure 2:
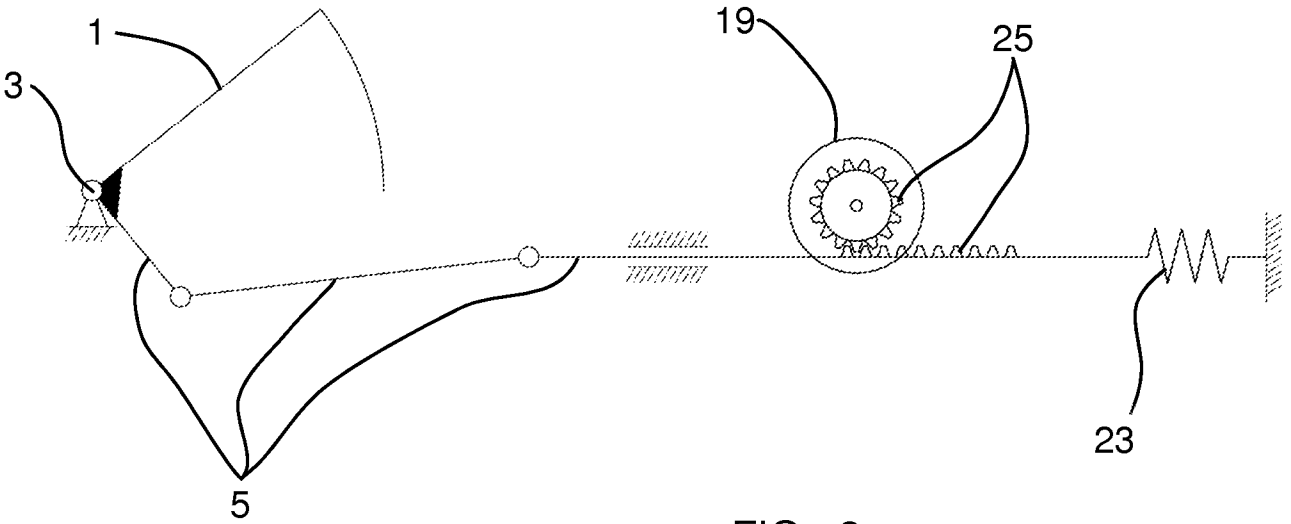
FIG. 2 is a schematic view of a second mechanism according to the invention.

FIG. 2 schematically shows an alternative embodiment. In this case, the first kinematic mechanism 5 is attached to a second kinematic conversion mechanism 25, which converts the translational movement back to a rotational movement (shown schematically with the rack and pinion). In this way the movement may be transmitted to the retaining means 19 which, in this example, is a centrifugal brake or a mechanical parachute system. As may be seen, this retaining means 19, which needs a rotational movement to be activated, could also have been placed on the shaft of rotation 3 or connected directly to the shaft of rotation 3 by way of kinematic transmission means based, for example, only on gears.

The invention claimed is:

1. A mechanism for reducing a speed of road traffic on public thoroughfares, the mechanism comprising:

a collapsible surface adapted to move reversibly between a first raised position and a second lowered position, wherein said collapsible surface is normally in said first raised position, such that said collapsible surface is visible to the road traffic;

a retaining means for retaining said collapsible surface in said raised position, said retaining means being adapted to be activated when a speed of movement of said collapsible surface is greater than a predetermined maximum speed, said retaining means comprising a centrifugal brake; and a means for kinematic transmission of the movement of the collapsible surface to a rotational member comprising activation means for activating said retaining means, from a particular angular speed.

2. A mechanism according to claim 1, wherein said collapsible surface moves between said first position and said second position by way of a rotational movement and the mechanism further comprises a first kinematic mechanism for converting said rotational movement into a translational movement.

3. A mechanism according to claim 2, wherein said first kinematic mechanism is connected to a rod of a piston of a hydraulic or pneumatic cylinder, said hydraulic or pneumatic cylinder having a first outlet and a second outlet of a fluid, wherein an external circuit comprises a parachute valve, said external circuit being provided between said first outlet and said second outlet.

4. A mechanism according to claim 3, wherein said rod is attached to a return spring means.

5. A mechanism according to claim 2, further comprising:

a second kinematic mechanism for conversion of said translational movement into a second rotational movement; and a centrifugal brake coupled to said second kinematic mechanism.

6. A mechanism according to claim 2, further comprising:

a second kinematic mechanism for conversion of said translational movement into a second rotational movement; and a centrifugal blocking means coupled to said second kinematic mechanism.

7. A mechanism according to claim 1, wherein said mechanism forms a speed bump for reducing the speed of road traffic on public thoroughfares.

8. A mechanism according to claim 1, further comprising:

another mechanism to provide two mechanisms, said two mechanisms forming a speed bump for reducing the speed of road traffic on public thoroughfares, each of said two mechanisms having a width of less than 1.2 m, wherein said two mechanisms are spaced apart from one another at a distance such that an automobile rides simultaneously over said two mechanisms, said two mechanisms being connected together by a stretch of fixed bump table.

9. A mechanism for reducing a speed of road traffic on public thoroughfares, the mechanism comprising:

a collapsible surface adapted to move reversibly between a first raised position and a second lowered position, wherein said collapsible surface is normally in said first raised position, such that said collapsible surface is visible to the road traffic;

a retaining means for retaining said collapsible surface in said raised position, said retaining means being adapted to be activated when a speed of movement of said collapsible surface is greater than a predetermined maximum speed, said retaining means comprising a mechanical parachute system; and a means for kinematic transmission of the movement of the collapsible surface to a rotational member comprising activation means for activating said retaining means, from a particular angular speed.

10. A mechanism according to claim 9, wherein said collapsible surface moves between said first position and said second position by way of a rotational movement and the mechanism further comprises a first kinematic mechanism for converting said rotational movement into a translational movement.

11. A mechanism according to claim 9, wherein said mechanism forms a speed bump for reducing the speed of road traffic on public thoroughfares.

12. A mechanism according to claim 9, further comprising:

another mechanism to provide two mechanisms, said two mechanisms forming a speed bump for reducing the speed of road traffic on public thoroughfares, each of said two mechanisms having a width of less than 1.2 m, wherein said two mechanisms are spaced apart from one another at a distance such that an automobile rides simultaneously over said two mechanisms, said two mechanisms being connected together by a stretch of fixed bump table.

13. A mechanism for reducing a speed of road traffic on public thoroughfares, the mechanism comprising:

a collapsible surface adapted to move reversibly between a first raised position and a second lowered position, wherein said collapsible surface is normally in said first raised position, such that said collapsible surface is visible to the road traffic;

a retaining means for retaining said collapsible surface in said raised position, said retaining means being adapted to be activated when a speed of movement of said collapsible surface is greater than a predetermined maximum speed; and a means for kinematic transmission of movement of the collapsible surface to a fluid of a hydraulic or pneumatic circuit, said hydraulic or pneumatic circuit comprising an activation means for activating said retaining means from a predetermined speed, pressure or flow-rate of said fluid, wherein said retaining means causes interruption of a flow of the fluid, which causes blocking of said kinematic transmission means.

14. A mechanism according to claim 13, wherein said collapsible surface moves between said first position and said second position by way of a rotational movement and the mechanism further comprises a first kinematic mechanism for converting said rotational movement into a translational movement.

15. A mechanism according to claim 13, wherein said retaining means comprises a parachute valve.

16. A mechanism according to claim 13, wherein said mechanism forms a speed bump for reducing the speed of road traffic on public thoroughfares.

17. A mechanism according to claim 13, further comprising:

another mechanism to provide two mechanisms, said two mechanisms forming a speed bump for reducing the speed of road traffic on public thoroughfares, each of said two mechanisms having a width of less than 1.2 m, wherein said two mechanisms are spaced apart from one another at a distance such that an automobile rides simultaneously over said two mechanisms, said two mechanisms being connected together by a stretch of fixed bump table.

* * * * *